United States Patent [19]

Lynch et al.

[11] 4,224,105

[45] Sep. 23, 1980

[54] APPARATUS FOR SIMULTANEOUSLY COVERING EACH OF A PLURALITY OF ELONGATED MATERIALS WITH UNIFORMLY WEIGHTED PULP INSULATION

[75] Inventors: Brian Lynch, Norcross; James G. Wright, Jr., Roswell, both of Ga.

[73] Assignee: Western Electric Company, Inc., New York, N.Y.

[21] Appl. No.: 16,689

[22] Filed: Mar. 2, 1979

Related U.S. Application Data

[62] Division of Ser. No. 892,344, Mar. 31, 1978.

[51] Int. Cl.[2] ..... D21H 1/00

[52] U.S. Cl. ..... 162/268; 162/300; 162/336

[58] Field of Search ..... 162/106, 267, 268, 300, 162/301, 336; 174/110 P; 427/121

[56] References Cited

U.S. PATENT DOCUMENTS

| | | | |
|---|---|---|---|
| 1,615,381 | 1/1927 | Hosford | 162/106 |
| 1,666,214 | 4/1928 | Little | 162/106 |
| 1,765,533 | 6/1930 | Jespersen | 162/106 |
| 3,810,817 | 5/1974 | Arledter | 162/301 |
| 3,867,252 | 2/1975 | Skrabak et al. | 162/268 |
| 3,888,729 | 6/1975 | Parker | 162/343 |
| 3,892,622 | 7/1975 | Skaugen | 162/268 |

*Primary Examiner*—Richard V. Fisher
*Assistant Examiner*—Peter Chin
*Attorney, Agent, or Firm*—E. W. Somers

[57] ABSTRACT

Paper pulp insulation of uniform weight per unit length is formed simultaneously on each of a plurality of advancing electrical conductors (21—21) by the use of a dual zone headbox (23) which cooperates with a forming cylinder (24). In one zone of the headbox, the average velocity of a pulpous mixture flowing in a channel (54) is controlled by a first velocity control member (58) after which the pulpous mixture is split into a plurality of streams to form a pulp ribbon (29) below each of the conductors on the periphery of the forming cylinder. In the other zone, the pulpous mixture is passed through a channel (57) prior to being split into individual streams that are deposited as ribbons (31—31) above the conductors. The average velocity of the pulpous mixture in the channel (57) in the other zone is controlled by a second velocity control member (66) having a plurality of discrete individually adjustable sections which are aligned with the streams. Selected sections of the second velocity control member (66) are adjusted to insure that the combined weight of each increment of the ribbon (31) of the pulpous mixture which is deposited above each conductor together with each associated increment of the underlying ribbon (29) is substantially constant.

4 Claims, 18 Drawing Figures

APPARATUS FOR SIMULTANEOUSLY COVERING EACH OF A PLURALITY OF ELONGATED MATERIALS WITH UNIFORMLY WEIGHTED PULP INSULATION

This is a division of application Ser. No. 892,344 filed Mar. 31. 1978.

TECHNICAL FIELD

The present invention relates to methods of and apparatus for covering elongated strand materials, and, more particularly, to the use of a dual zone headbox in cooperation with a vacuum cylinder to simultaneously cover each of a plurality of electrical conductors with pulp insulation which is uniformly weighted per unit length along each of the conductors.

BACKGROUND ART

In the manufacture of paper-pulp-insulated conductors, a plurality of conductors are moved into engagement with a rotatable drum for a portion of its rotation, while a pulpous mixture is deposited from a pulpous mixture distributor onto the drum and transferred to the conductors in the form of ribbons. A stationary vacuum box, located interiorly of the drum, causes the pulpous mixture from the distributor, which is referred to as a headbox, to be formed into ribbons on the drum and removes a large portion of their moisture content. See, for example, U.S. Pat. No. 1,765,533, issued to H. W. Jespersen on June 24, 1930. In another process, a pulpous mixture is transferred from a drum, which is mounted rotatably and submerged partially in a vat of the pulpous material, to conductors which are moved into tangential engagement with the drum. In either process, the pulp ribbons and conductors are then moved into engagement with an endless felt web which is passed between rolls to cause moisture to be removed from the pulp. Then the pulp ribbons and conductors are disengaged from the felt web and the pulp is subsequently formed into circular layers of insulation about the conductors.

The pulp ribbons produced by these prior art processes are not uniform in weight among all of the conductors, which results in changes in electrical properties of the conductors such as, for example, mutual capacitance when they are twisted together in pairs. Also, processes for pulp-insulating conductors have not been entirely successful in matching the velocity of the pulpous mixture with that of the cylinder at their confluence, notwithstanding the relatively low line speeds, e.g. 46 to 61 meters per minute (mpm), at which these processes are run. This affects elongation and tensile properties of the pulp insulation that are important because of the way in which the insulated conductors or cables are handled. If the velocity of the pulpous mixture leads that of the cylinder, a stagnation zone is established which results in fibers of the mixture having a random or so-called "cross-machine" orientation with decreased tensile strength; if it lags, the pulp fibers are oriented longitudinally, parallel to one another and have increased tensile strength but reduced elongation properties. Weight control of the pulpous mixture on the conductors is desirably accompanied by a suitable matching of the pulpous mixture and cylinder velocities to achieve an optimum combination of tensile and elongation properties.

The problem of non-uniform pulp weight has been overcome in the paper-making industry by the use of a blade valve which is capable of being moved closer to or farther from a bed and is adjustable along a continuous profile. The paper-making industry has also been successful in matching velocities of pulpous mixtures and cylinders by the use of the above-described blade valve, and in controlling the formation of relatively thick sheets by using a laminating procedure or a succession of headboxes.

However, nowhere has the prior art focused its attention on methods or apparatus which may be used to control the coating of strand materials with a pulpous mixture to achieve uniformly weighted pulp insulation having required elongation and tensile properties.

DISCLOSURE OF THE INVENTION

The foregoing problems are overcome by the methods and apparatus of this invention in which each of a plurality of conductors is coated with a pulpous mixture to achieve uniformly weighted pulp insulation as among all the conductors at line speeds substantially higher than those which have been customary in the art. A method of applying a pulpous mixture to a plurality of electrical conductors to form a uniformly weighted insulation on each of the conductors includes the steps of advancing a plurality of conductors, flowing a pulpous material along each of two channels, and controlling the average velocity of a pulpous material in each of the two channels. The pulpous material flowing through each of the channels is divided into a plurality of streams, with each of the streams of pulpous material from one of the channels being formed into a ribbon underlying each one of the plurality of conductors and each of the streams from the other channel being formed into a ribbon overlying each one of the plurality of conductors. The rates of flow of selected portions of pulpous material through at least one of the channels are adjusted to cause each increment of length of the ribbons underlying and overlying each conductor to have a combined weight which is substantially constant.

In accordance with another aspect of the invention, means are provided for advancing a plurality of conductors along paths between a cylinder and a dual zone headbox in which a pulpous mixture is moved in a channel in each zone and split into individual streams that are deposited into engagement with each conductor in the form of ribbons on opposite sides thereof. Prior to its being split into a plurality of streams in the channels, the pulpous mixture in each zone is moved past a blade valve which permits control of the average velocity of the pulpous mixture. The valve in the zone which is associated with the overlying ribbon comprises a plurality of individually controllable sections for trimming of individual overlying ribbon weights to achieve increments of composite pulp insulation which are uniformly weighted among all the conductors as the conductors are moved from the headbox.

BRIEF DESCRIPTION OF THE DRAWINGS

A more detailed understanding of the invention may be had from the following description with reference to the accompanying drawings, in which.

DETAILED DESCRIPTION

The apparatus to be described hereinafter is effective to apply increments of pulp insulation simultaneously to each of a plurality of conductors 21—21 (see FIG. 1) which are being advanced through the apparatus such that the increments of pulp insulation among all of the conductors are uniform in weight. While the invention is directed to the application of increments of a uniformly weighted pulpous mixture simultaneously to each of the plurality of conductors 21—21, it should be apparent that if control is exercised over the consistency of the pulpous mixture, the insulation will be of uniform weight along the lengths of all the conductors.

Figure 1:
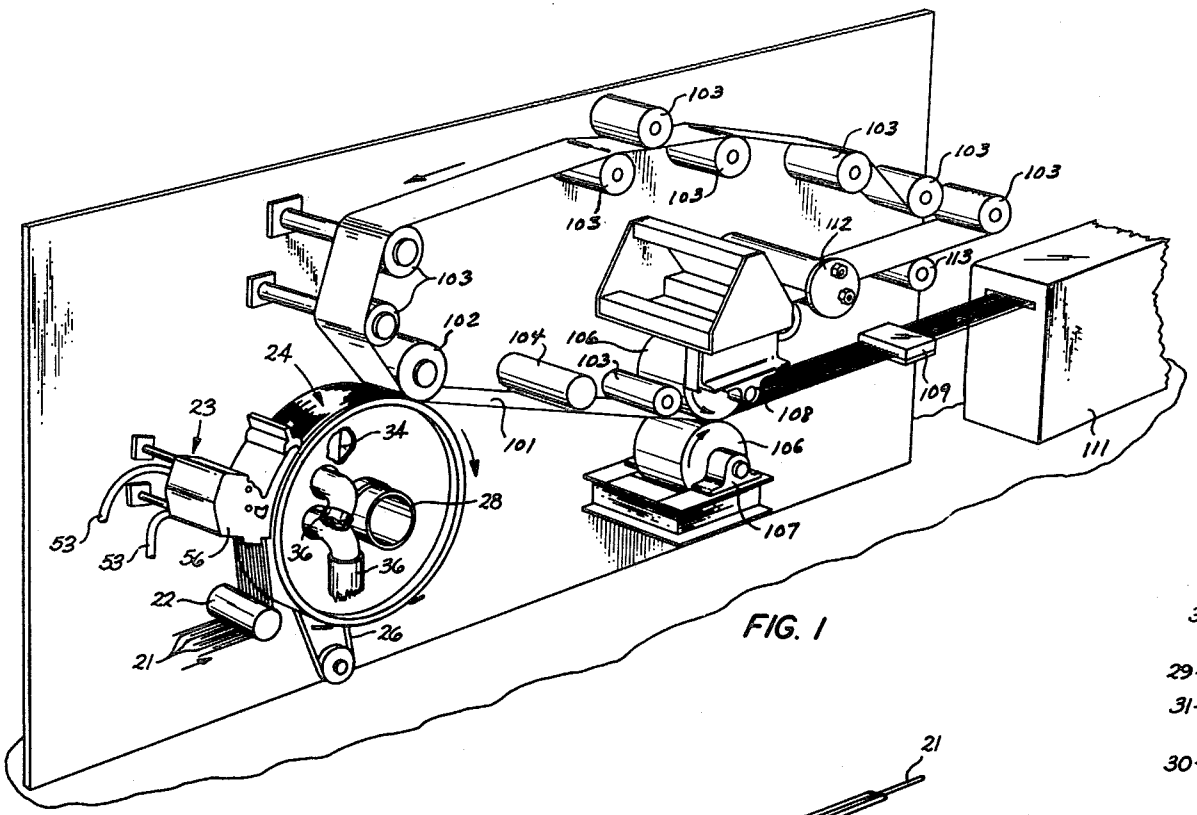
FIG. 1 is a perspective view of an apparatus which embodies the principles of this invention for forming paper pulp insulation on each of a plurality of conductors.

Referring now to FIG. 1, the conductors 21—21 are passed around a rotatable idler roll 22 and are then directed between a multi-ribbon dual zone headbox, designated generally by the numeral 23 and a vacuum forming cylinder, designated generally by the numeral 24. While the conductors 21—21 are shown as being solid conductors, it should be understood that they could also be comprised of a strand material.

Figure 2:
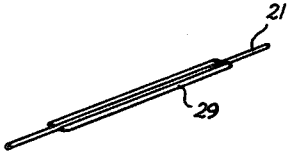
FIG. 2 is a view of a single conductor after having been passed through one zone of the dual zone headbox with a paper pulp ribbon having been formed under the conductor.
Figure 3:
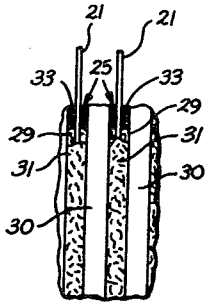
FIG. 3 is a view of a pair of conductors as they leave the headbox in engagement with a vacuum forming cylinder and having paper pulp ribbons below and above the conductors.
Figure 4:
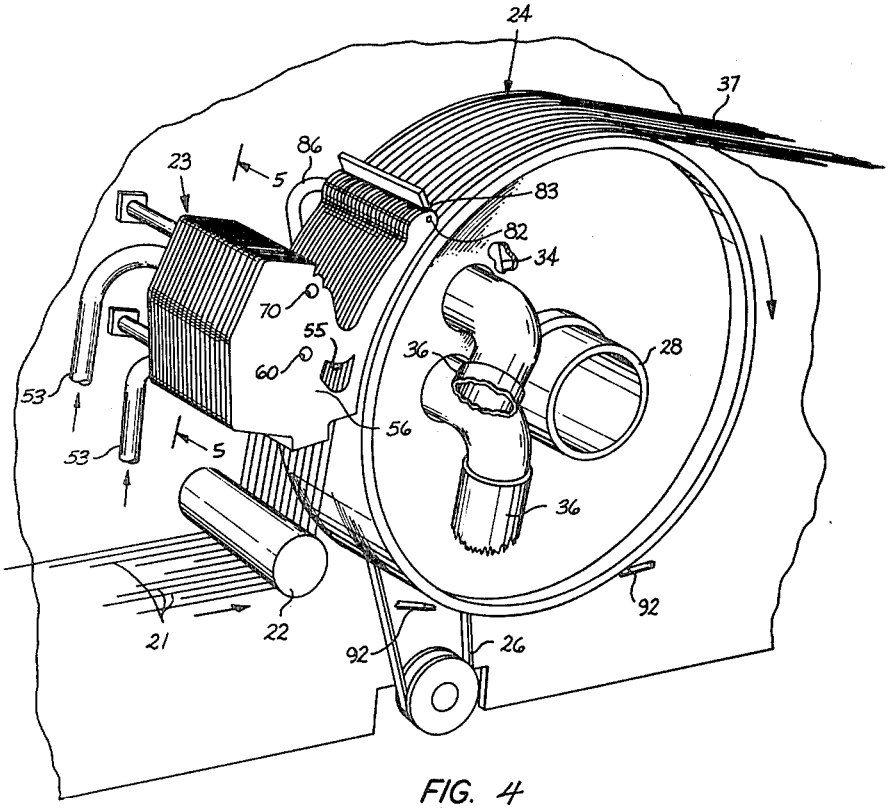
FIG. 4 is an enlarged perspective view of a portion of the apparatus of FIG. 1 and showing the dual zone headbox and the vacuum forming cylinder.

The cylinder 24, which is turned rotatably by a drive belt 26 about a stationary tubular support member 28, has a plurality of circumferential stripes 25—25 (see FIG. 3) adjacent a double layer of coarse and fine metallic (or non-metallic) mesh, shown as 32 and 33, respectively (see also FIG. 15), and interspaced by masked portions 30—30 on the outer surface of the cylinder 24. The cylinder 24 is also provided with a non-rotatable vacuum box which is divided into two sections 34—34 with a negative pressure in each section capable of being controlled. As the conductors 21—21 are passed through the dual zone headbox 23 in positions aligned with the stripes 25—25 on the mesh screens 32 and 33 on the cylinder 24, a pulp ribbon 29 about 0.64 cm wide is formed substantially over the width of each of the stripes 25—25 and under the associated conductor, as shown in FIG. 2, after which a pulp ribbon 31 of the same width is formed over each of the conductors (see FIG. 3).

The dual zone headbox 23 in FIG. 1, is shown in more detail in FIGS. 4 to 12, inclusive, and includes two inputs 51 and 52 for pulpous mixture or slurry. The pulpous mixture comprises pulp fibers suspended in a carrier and possibly other constituents such as, for example, binders (see *Pulp and Paper Technology* Vol. II - Paper McGraw - Hill Book Co. 1962). The pulpous mixture is supplied along lines 53—53 from a metering system (not shown) and through a rear one of two end plates 56—56 (see FIG. 10) which have openings 55—55. The pulpous mixture from the input 51 is directed to a first zone of the dual headbox 23 along a tortuous channel 54 (see FIG. 5) which extends substantially the width of the headbox 23 between the end plates 56—56 while the pulpous mixture from the input 52 is directed into a second zone along a tortuous channel 57 which also extends substantially the width of the headbox 23.

The pulpous mixture flows through the channel 54 past a velocity control member 58 which is often referred to as a valve and permits control of the average velocity of the mixture. The velocity control member 58, which extends substantially the width of the headbox 23, is secured to a shaft 59 having its ends received in apertures 60—60 (see FIG. 10) in the end plates 56—56 and may be turned by the shaft so that an edge portion 61 may be moved toward or away from a wall of the channel 54. The adjustment of the spacing of the edge portion 61 from the wall of the channel 54 results in the pulpous mixture being launched from the channel 54 in a flow having a controllable average velocity as measured across the width of the channel.

Figure 12:
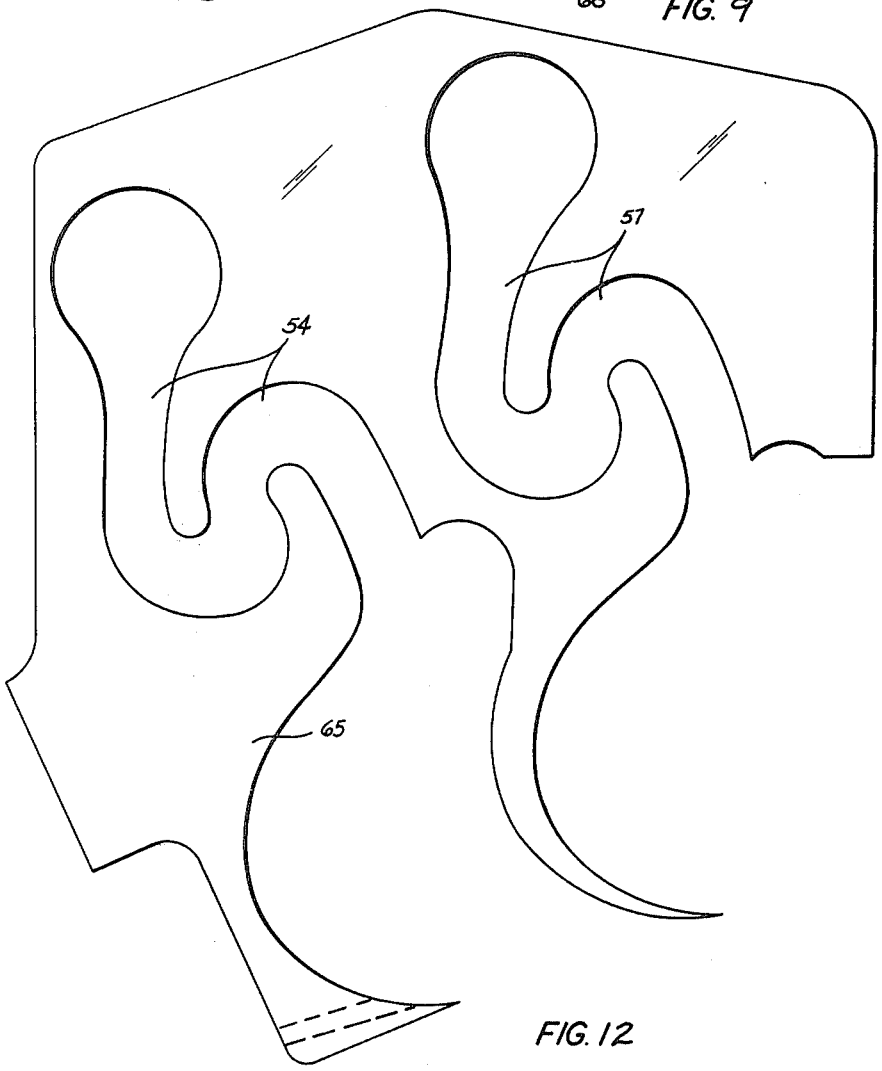
FIG. 12 is an enlarged front view of a spacer plate in the headbox of FIG. 5.
Figure 11:
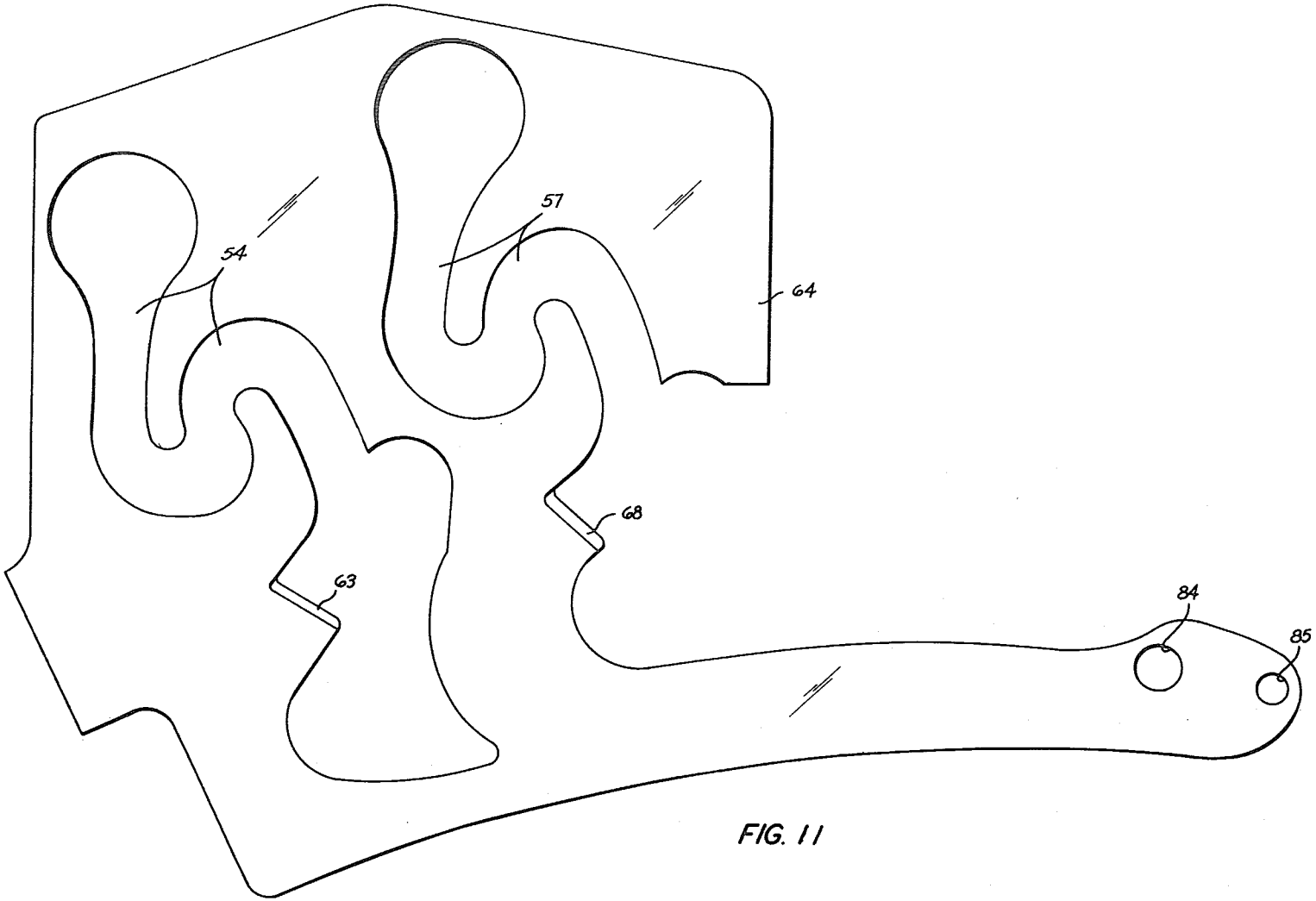
FIG. 11 is an enlarged front elevational view of a splitter plate of the headbox of FIG. 5.

Beyond the velocity control member 58, the channel 54 is divided into a number of streams 62 (see FIGS. 5 and 7) by a plurality of splitter edges 63—63, formed on splitter plates 64—64 (see FIG. 11), that are interposed between spacer plates 65—65 (see FIG. 12). Both the splitter plates 64—64 and the spacer plates 65—65 extend to the bottom of the first zone of the headbox 23. Each of the streams 62—62 has an individual conductor 21 passing therethrough and is substantially the width of each of the unmasked stripes 25—25 (see FIG. 3) of the drum 24. Because of the interposed spacer plates 65—65 and the openings 55—55 in the end plates 56—56, the channels 62—62 are exposed to the atmosphere at their tops to permit the vacuum box sections 34—34 (see FIG. 13) in the forming cylinder 24 to operate satisfactorily. Inasmuch as the pulpous mixture enters the streams 62—62 from a somewhat laminar flow, it tends to follow the left side of the walls, as viewed in FIG. 5. Since the dual zone headbox 23 is formed by a pair of the end plates 56—56 and alternating ones of the splitter plates 64—64 (see FIG. 11) and spacer plates 65—65 (see FIG. 12), the number of the plates 64 and 65 may be varied depending on the number of conductors 21—21 to be insulated.

Figure 5:
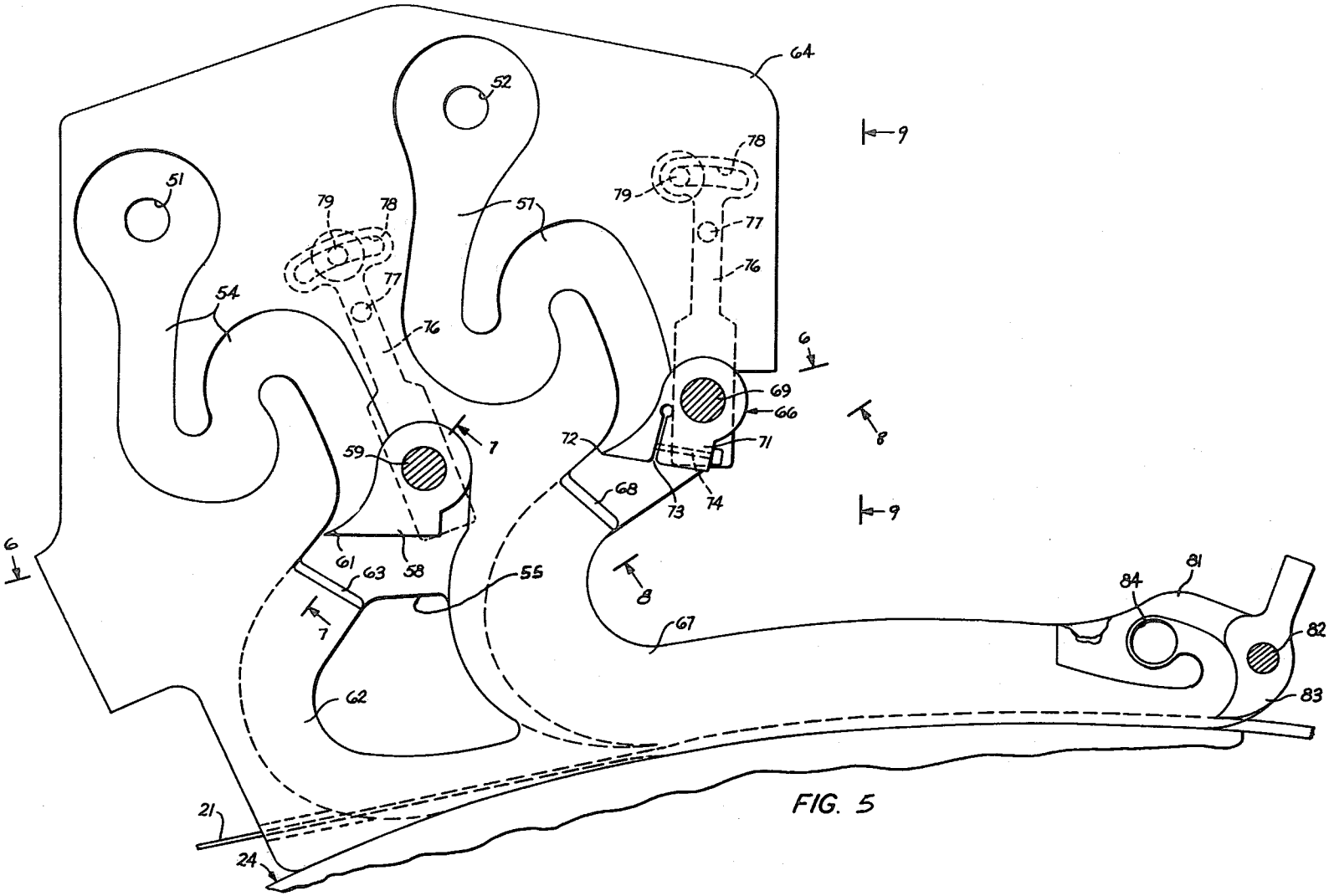
FIG. 5 is an enlarged view of the dual zone headbox and taken along lines 5—5 of FIG. 4.
Figures 7, 10:
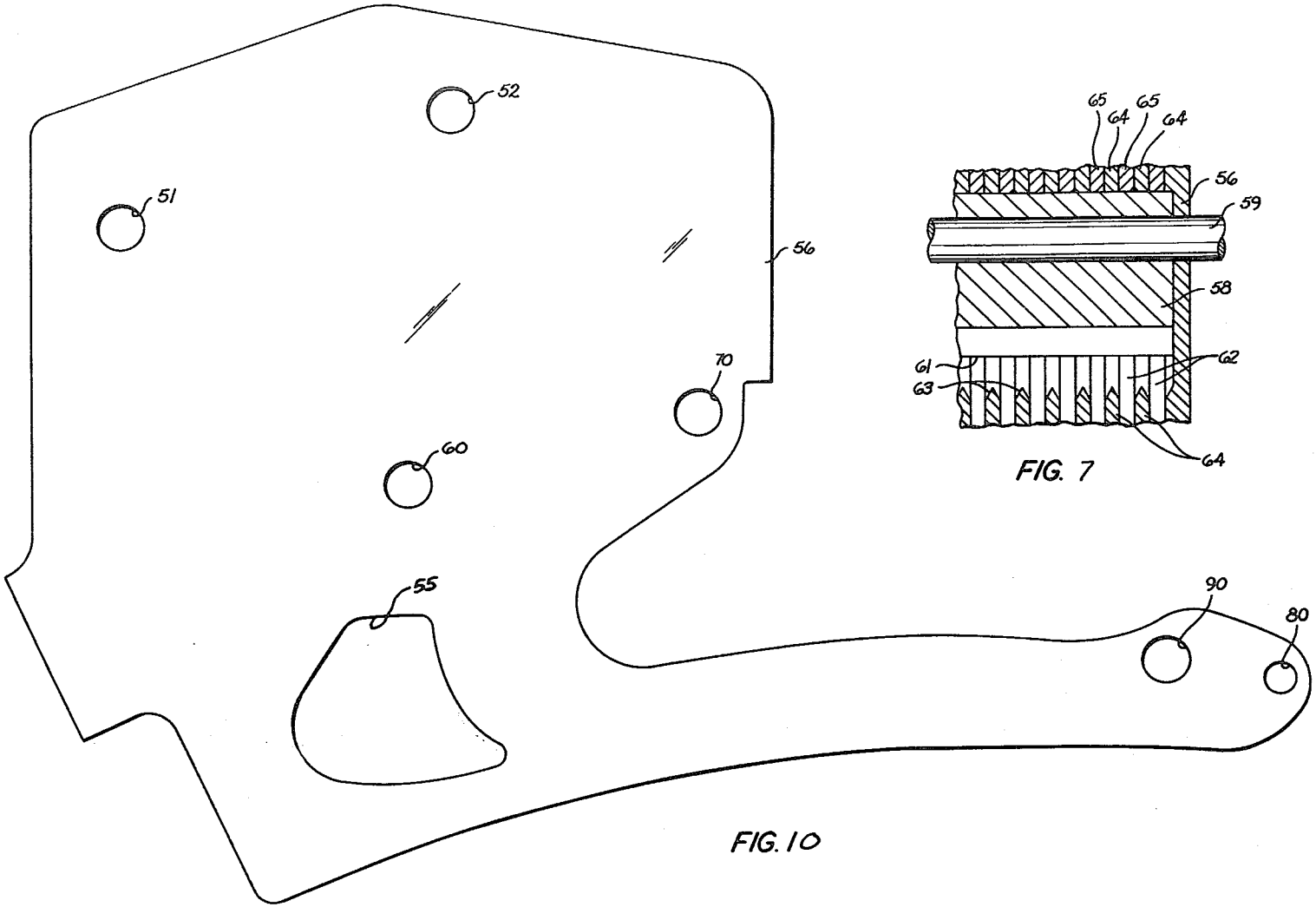
FIG. 7 is a partial cross-sectional view taken along lines 7—7 of FIG. 5.
FIG. 10 is an enlarged view showing a rear end plate of the headbox of FIG. 5.
Figure 8:
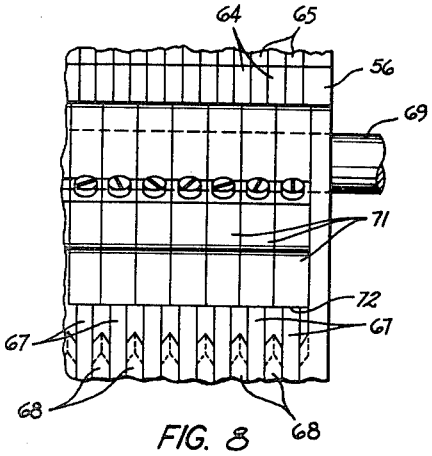
FIG. 8 is a partial cross-sectional view taken along lines 8—8 of FIG. 5.
Figure 9:
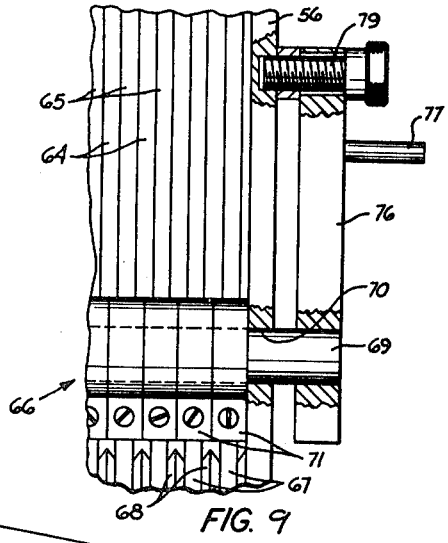
FIG. 9 is a partial cross-sectional view, partly broken away, taken along lines 9—9 of FIG. 5.

Similarly, the pulpous mixture from the inlet 52 follows a tortuous path defined by the channel 57 to a second velocity control member 66. Beyond the member 66, there are a plurality of streams 67—67, having a width equal to the unmasked stripes 25—25 (see FIG. 3) of the cylinder 24 and formed by splitter edges 68—68 on splitter plates 64—64 (see FIGS. 5, 8, 9 and 11), and a plurality of spacer plates 65—65 (see FIG. 12) which alternate with the plates 64—64. As can be seen in FIG. 5, the streams 67—67, which like the streams 62—62 open to the atmosphere at their tops so that the vacuum box sections 34—34 will operate properly, extend to the bottom and then to the right extremity of the second zone of the headbox 23 where they are intersected by or merge with the channels 62—62.

The velocity control member 66 is secured to a shaft 69, which terminates in apertures 70—70 (see FIG. 10) in the end plates 56—56, and comprises a plurality of individual members 71—71, each of which is associated with one of the individual streams 67—67. The members 71—71 are movable as a unit with the shaft 69 so that edge portions 72—72 thereof may be toward or away from the wall of the channel 57 to cause the pulpous mixture to leave the channel 57 in a flow pattern which follows the left wall of the channel 57, as viewed in FIG. 5.

Each of the members 71—71 is individually adjustable with respect to its spacing in an operated condition from the channel wall which permits a trimming, i.e. an adjustment of the rate of flow, of associated portions of the pulpous mixture that is flowing in the channel 57. By a suitable trimming of the portions of the pulpous mixture, the weights of the individual topmost ribbons 31—31 applied from the second zone together with the ribbons 29—29 from the first zone provide uniform weight ribbons. In order to accomplish the trimming, the individual members 71—71 are each provided with a slot 73 and an adjusting bolt 74 extending partially therethrough at right angles to the slot 73. As the bolt 74 is turned, its end causes the edge portion 72 to be moved toward or away from the wall of the channel 57.

Since both velocity control members 58 and 66 are movable under the control of similar mechanisms (see FIGS. 5 and 9), only the mechanism associated with the member 66 will be described in detail and similar numerals will be used to identify like parts in both mechanisms. The mechanisms are supported from the external side of the rear end plate 56 and include an arm 76 which extends upwardly from and is attached to the end of the shaft 69 which passes through the aperture 70 in the rear end plate 56. The arm 76 is provided with an operating handle 77 which at its upper extremity has an arcuately shaped aperture 78. A headed bolt 79 is threaded into the rear end plate 56 with the bolt 79 passing through the arcuately shaped aperture 78. By loosening the bolt 79, the handles 77—77 may be moved in either direction in the aperture 78 to turn the shaft 69 and cause the edge portions 72—72 of the members 71—71 to be moved toward or away from the wall of the channel 57. Similarly, the edge portions 61—61 of the member 58 are moved toward or away from the wall of the channel 54 through rotation of the shaft 59, which also passes through the aperture 60 in the rear end plate 56.

After the portions of the pulpous mixture which is flowing in the channel 57 have been trimmed by the individual members 71—71, the pulpous mixture is launched into engagement with the splitter edges 68—68 of the splitter plates 64—64. Because of the relatively short distance of about 3 cm between the members 71—71 and the splitter edges 68—68 and because of the velocity of the pulpous mixture, the trimmed portions substantially maintain their identity as they flow into their separate associated streams 67—67.

It should be understood that while the apparatus has been described with the blade valve 66 having discretely adjustable members 71—71 in the channel 57, the blade valve 58 or both valves could be constructed in a similar manner. Further it should be understood that the mechanism just described could be replaced with an automatic system which is controlled by feedback characteristics of the ribbons.

The dual zone headbox 23 is also constructed so that each of the streams 67—67 near the rightward extremity of the second zone as viewed in FIG. 5 is provided with a spacer insert 81 which is fastened to the channel walls. A rod 82, mounted in apertures 80 in the end plates 56—56 (see FIGS. 5 and 10), is passed through the inserts 81—81 and apertures 85—85 of the splitter plates 64—64. The rod 82 has a pivotally mounted, pulpous mixture flow diverter 83 depending therefrom which rides substantially on the laminate which comprises the conductors 21—21 and the ribbons 29 and 31. The flow diverter 83 causes excess slurry to reverse its direction of motion and enter an aperture 84 which extends substantially the width of the headbox 23 and terminates in an aperture 90 in the rear end plate 56, connected to an exhaust line 86, to cause the pulpous mixture to be returned to the metering system (not shown).

Figure 14:
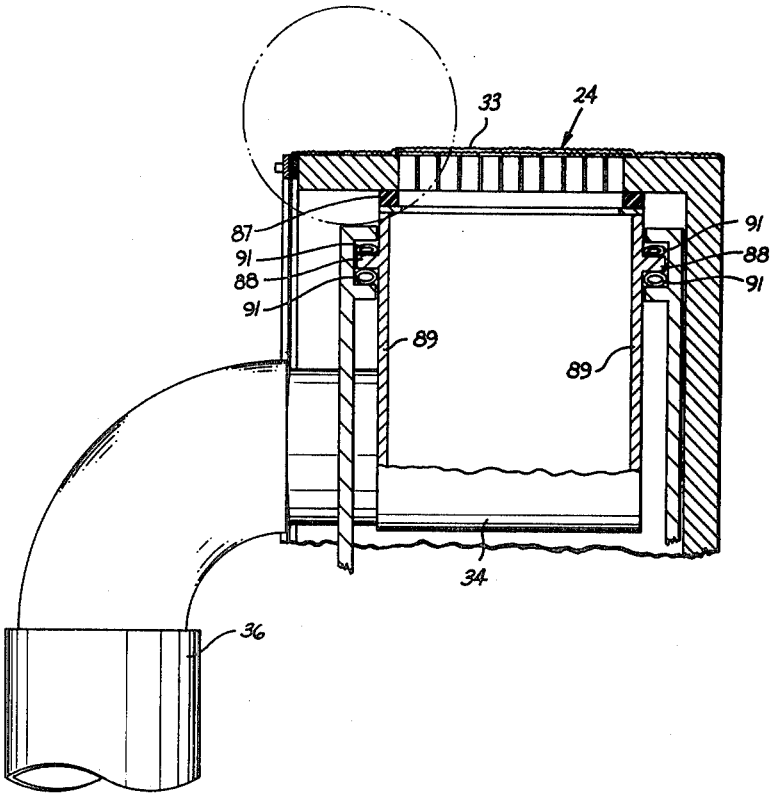
FIG. 14 is a cross-sectional view taken along lines 14—14 of FIG. 13.
Figure 15:
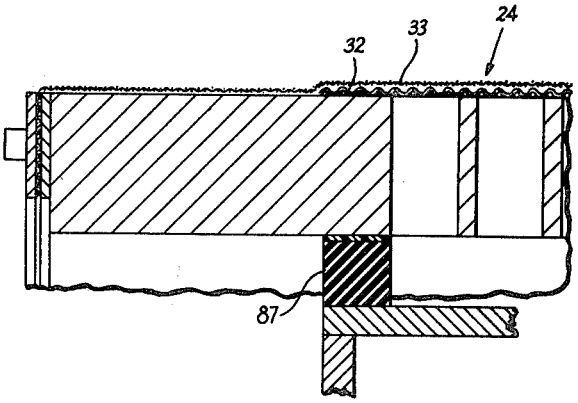
FIG. 15 is an enlarged view in section of the circled portion of the headbox shown in FIG. 14.

The cylinder 24 is provided with two stationary vacuum box sections 34—34 (see FIGS. 13 and 14) which are separated from the wire meshes 32 and 33 by a honeycomb configuration and isolated from ambient atmosphere by a seal 87 (see also FIG. 15). In order to be able to adjust the sections 34—34 toward the wire meshes 32 and 33, each vacuum box sections has portions 88—88 projecting from sidewalls 89 with pneumatic tubes 91—91 positioned on opposite sides of the projecting portions 88—88. The inflation of the tubes 91—91 is controlled to cause the upper and lower pneumatic tubes 91—91 of the boxes 34—34 to be raised or lowered radially with respect to the inside surfaces of the cylinder 24 to compensate for any wear of the seal 87. Further, the tubes 91—91 are used to compensate for the inherent lifting feature of the vacuum when applied to the sections 34—34 as the pulp ribbons 29 and 31 are being formed on the conductors 21—21.

Figure 13:
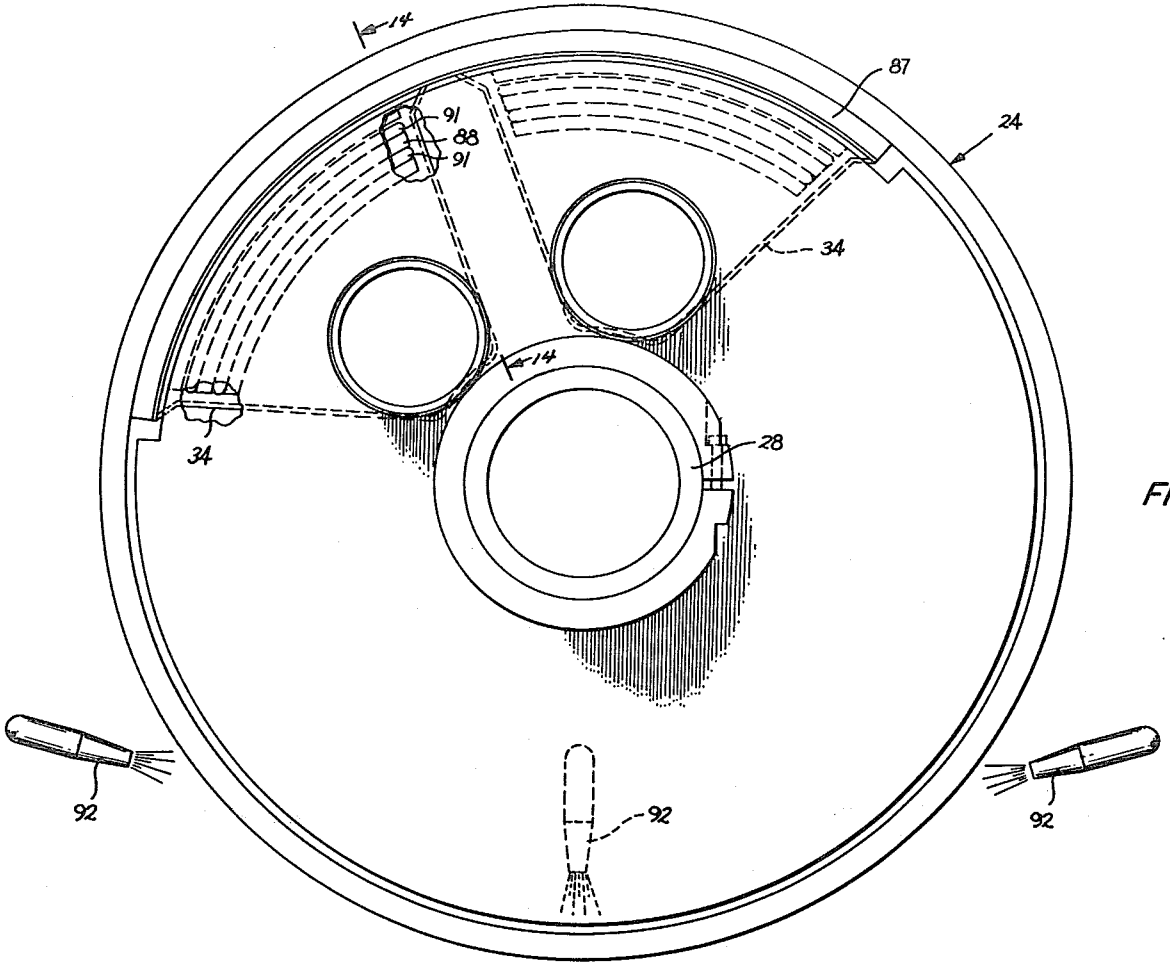
FIG. 13 is an enlarged front elevational view of the vacuum forming cylinder of FIG. 4.

Still referring to FIG. 13, it may be seen that nozzles 92—92 are mounted adjacent the cylinder 24 to apply streams of water to both the inner and outer sections of the cylinder and to the wire meshes 32 and 33. This cleans the wire meshes 32 and 33 of any slurry, and also serves as a water lubricant and seal for the vacuum sections 34—34 with respect to the rotating cylinder 24.

Figure 16:
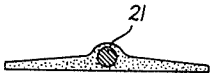
FIG. 16 is an enlarged cross-sectional view of a conductor after having been covered between lower and upper pulp ribbons and as the conductor is moved from the headbox.

As can be seen in FIG. 5, the conductors 21—21 approach the cylinder 24 tangentially and do not engage the meshes 32 and 33 on the outer surface thereof until they have passed partially through the first zone streams 62—62. This permits the pulpous mixture to engage the meshes 32 and 33 under the conductors 21—21 to form the ribbons 29—29. Thereafter, as the ribbons 29 of pulpous mixture and conductors 21 enter the second zone streams 67—67, ribbons 31—31 of the pulpous mixture are formed over the conductors 21—21 to form a composite ribbon such as shown in FIG. 16. During the rotation of the cylinder 24, the stationary vacuum box sections 34—34 causes the ribbons 29 and 31 to be formed on the meshes 32 and 33 of the cylinder 24, substantially equal in width to the stripes 25—25 on the forming cylinder 24.

Figure 17:
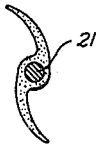
FIGS. 17 and 18 are enlarged cross-sectional views of the pulp insulation during and following a polishing operation in which the ribbons are formed into a circularly configured covering.
Figure 18:
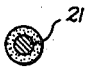
Figure 6:
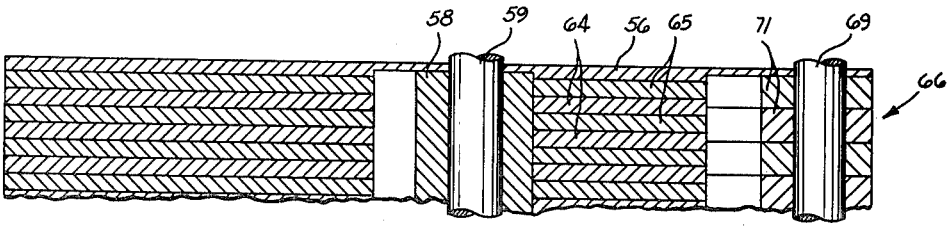
FIG. 6 is a partial cross-sectional view of the dual zone headbox along lines 6—6 of FIG. 5.

As they leave the forming cylinder 24, the conductors 21—21 are moved into engagement and along with a continuous transfer felt web 101 which is directed adjacent the cylinder 24 by a vacuum couch roll 102, (see FIG. 1). As the felt web 101 leaves the cylinder 24, the conductors 21—21 together with the ribbons 29 and 31 thereon are transferred from the cylinder to the underside of the felt web. The felt web 101, which is advanced over idler rolls 103—103 and past a suction box 104, is driven by an upper one of a pair of press rolls 106—106, which are secured adjustably and rotatably in roll stands 107 and 108. The press rolls 106—106 squeeze excess moisture from and consolidate the ribbons 29 and 31 after which the conductors 21—21 with the ribbons 29 and 31 are directed away from the felt web and through individual polishers 109—109. The polishers 109—109, which are well known in the art, form the ribbons 29 and 31 generally as shown in FIG. 17 and then in the circular form shown in FIG. 18. After the conductors 21—21 and the formed pulp ribbons 29 and 31 are moved out of engagement with the polishers 109—109 with the configuration shown in FIG. 18, they are advanced through a dryer III such as, for example, an infrared oven, where the moisture in the formed ribbons 29 and 31 is removed almost completely, and are taken up on reels (not shown). After its disengagement from the conductors 21—21, the felt web passes through a wash box 112 and a suction box 113 where excess moisture is removed from the web.

It has been found that with the equipment described above that it is possible to obtain high speed operation. As an example, it is possible to pulp-insulate a plurality of conductors 21—21 preferably of copper wire, at line speeds, e.g. 304 meters per minute, which were not previously obtainable.

EXAMPLE

Portions of a pulpous mixture flowing in the channel 57 at the rate of about 5.3 liters per minute (lpm) were trimmed by the individual members 71—71 which were spaced about 0.5 cm from the channel wall. Then the pulpous mixture was launched at a velocity of about 152 meters per minute into engagement with the splitter edges 68—68 of the splitter plates 64—64. The pulpous mixture was flowed in the channel 54, past the velocity control member 58 and launched at a velocity of about 152 meters per minute into engagement with the splitter edges 63—63. Pulpous mixture ribbons each about 0.64 cm in width were deposited under and over each of the conductors 21—21. If higher launch speeds are used, then the flow rate of the pulpous mixture should be increased in order to maintain matched velocities of the pulpous mixture and the forming cylinder.

Although a specific embodiment of the invention has been shown and described, it will be understood that this embodiment is but illustrative and that various modifications may be made therein without departing from the scope and spirit of the invention.

What is claimed is:

1. An apparatus for supplying a pulpous mixture to a plurality of electrical conductors to form pulp insulation thereon which is uniform in weight among the conductors, which comprises;

a vacuum-forming surface;

means for advancing a plurality of conductors into engagement with said vacuum-forming surface;

a headbox adjacent said conductors and said vacuum-forming surface, said headbox comprising;

(A) a first zone, said first zone comprising:

a first channel for conveying a pulpous mixture;

means for supplying a pulpous mixture through said channel;

means for dividing the pulpous mixture flowing in said channel into a plurality of individual streams, each of said streams associated with one of said conductors, said dividing means causing a ribbon of pulpous material to be formed on said vacuum forming surface under each conductor; and means common to in said first zone of said headbox for controlling the relative average volumetric flow rate of a pulpous mixture; and (B) a second zone, said second zone comprising:

a second channel for conveying a pulpous mixture;

means for supplying the pulpous mixture to said channel associated with the second zone;

means for dividing the pulpous mixture flowing in said second channel into a plurality of individual streams, each said streams being associated with one of said conductors and one of said streams in said first zone, said dividing means causing a ribbon of pulpous material to be formed over each of said conductors on said vacuum forming surface; and adjustable control means for trimming the relative average volumetric flow rate of the pulpous mixture in the individual streams of said second zone such that the final ribbon weights are substantially uniform among all the conductors.

2. The apparatus of claim 1, wherein the adjustable control means includes means for adjusting the rates of flow in substantially discrete steps within the second channel.

3. The apparatus of claim 1, wherein the conductors are advanced into engagement with said vacuum forming surface at a tangent thereto and are so positioned that the conductors do not engage the vacuum forming surface until passing partly through said plurality of streams of said first zone with the pulp ribbons formed thereunder.

4. The apparatus of claim 1, wherein said vacuum forming surface is formed of two internal non-rotatable vacuum box sections which are individually moveable in a radial direction.

* * * * *